US005096075A

United States Patent [19]

Glover

[11] Patent Number: 5,096,075

[45] Date of Patent: Mar. 17, 1992

[54] SLACKLESS DRAWBAR WITH GRAVITY RESPONSIVE WEDGE

[75] Inventor: Mary A. Glover, Pittsburgh, Pa.

[73] Assignee: McConway & Torley Corporation, Pittsburgh, Pa.

[21] Appl. No.: 352,932

[22] Filed: May 17, 1989

[51] Int. Cl.[5] ..... B61G 1/28; B61G 7/10; B61G 9/04

[52] U.S. Cl. ..... 213/61; 213/62 R; 213/75 R

[58] Field of Search ..... 213/50.5, 56, 61, 62 A, 213/62 R, 69, 72, 75 R, 50, 71, 78

[56] References Cited

U.S. PATENT DOCUMENTS

| | | | |
|---|---|---|---|
| 1,443,716 | 1/1923 | Pletcher | 213/62 R |
| 2,241,353 | 5/1941 | Kinne et al. | 213/72 |
| 3,635,357 | 1/1972 | Altherr | 213/62 R X |
| 3,716,146 | 2/1973 | Altherr | 213/69 X |
| 4,456,133 | 6/1984 | Altherr et al. | 213/62 R |
| 4,555,033 | 11/1985 | Miller | 213/62 R X |
| 4,580,686 | 4/1986 | Elliott | 105/3 X |
| 4,593,827 | 6/1986 | Altherr | 213/62 R X |
| 4,700,853 | 10/1987 | Altherr et al. | 213/62 R X |
| 4,700,854 | 10/1987 | Chadwick | 213/62 R |
| 4,863,045 | 9/1989 | Altherr | 213/78 |

*Primary Examiner*—Matthew C. Graham
*Assistant Examiner*—Alfred Muratori
*Attorney, Agent, or Firm*—Armstrong, Nikaido, Marmelstein, Kubovcik and Murray

[57] ABSTRACT

A drawbar coupler for a railway car having a center sill is disclosed for connecting two railway cars together in a slackless arrangement and provide uni-train service. The drawbar coupler is particularly characterized by a quick disconnect feature. The coupler includes a drawbar having at each end a vertical pin hole to receive a cylindrical pin that is held at its top and bottom end portions in a drawbar support casing that is in turn connected by weld to the center sill. Draft loads are imposed on a bearing block having curved bearing surfaces and fitted in the pin hole between the drawbar and the pin. Buff loads are transferred from the butt portion of the drawbar to a bearing block that is acted upon by a gravity actuated wedge placed between the bearing block and end wall of the support casing. Two support plates extend across the bottom of the casing and can be removed to permit removal of the vertical pin as well as the bearing block.

13 Claims, 2 Drawing Sheets

SLACKLESS DRAWBAR WITH GRAVITY RESPONSIVE WEDGE

BACKGROUND OF THE INVENTION

1. Field of the Invention

This invention relates to a drawbar for coupling together railway cars in a fashion to provide unit train service while providing horizontal and vertical angling of the drawbar and eliminating slack in the coupling system of parts. More particularly, the present invention relates to such a drawbar wherein a vertical pivot pin engages walls of a carrier housing to provide an arrangement that minimizes friction between the parts during angling and allows for a quick disconnect between the drawbar and the railway car.

2. Description of the Prior Art

Conventional E-Type; F-Type and E/F-Type railroad couplers are relatively complicated assemblies used in conjunction with a car sill, draft gear, yoke, follower blocks, striker, pin or coupler connection. Such conventional coupler arrangements have a degree of free and cushioned slack. That is, there is a certain amount of free "play" between the coupler components when the load changes from a draft to a buff load and vice versa. At the same time, the draft gear acts as a spring mechanism to cushion impacts between adjacent cars. It has been found that eliminating the free and cushioned slack within a train will eliminate over the road train action forces due to "run-ins" and "run-outs". The magnitudes of these forces are large and cause significant wear and tear on the rolling stock. In some instances the forces are severe enough to cause derailments.

Furthermore, in conventional coupler assemblies, the key or pin connection of the coupler to the yoke is at a relatively long distance from the kingpin about which the wheel truck rotates. In negotiating curves, particularly under buff loading conditions, this gives rise to relatively large lateral forces which can cause derailment. The same is true when jackknifing occurs under buff loads with lateral forces attempting to rotate the cars about their centers.

In U.S. Pat. No. 4,580,686 there is disclosed a slackless self-adjusting rotary drawbar for railway cars which allows a railway car to be rotated in unit train service independent of the railway cars coupled thereto to effect a dumping operation of cargo as usually contained in a hopper of a railway car. This known drawbar arrangement requires that the drawbar have essentially hemispherical buff and draft load bearing surfaces on the forward and rear portions of a enlarged spherical butt end portion. Each of the hemispherical surfaces engage with corresponding front draft and rear buff bearing blocks that are in turn contained within a center sill by rear draft lugs and front draft lugs. The draft lugs are secured by weld metal to the center sill. Slackless operations are achieved by a gravity wedge operatively arranged between the rear draft lugs and the buff load bearing block. The components of the drawbar arrangement are contained within the center sill by a bottom plate attached to oppositely extending flange sections of the center sill. The spherical contour provided on the enlarged butt end portion of the drawbar is necessary to achieve rotary operation of one railway vehicle with respect to the adjoined vehicle connected thereto by the drawbar. While this drawbar has many desirable features including the rotary dumping feature when such features are not necessary it has been found that the large surface area formed by the hemispherical buff and draft surfaces impose unusually large frictional forces that may impede necessary freedom for angling of the drawbar relative to the center sill. Moreover, the multiplicity of dissociated parts particularly, for example, the front and rear draft lugs renders alignment of the hemispherical buff and draft bearing surfaces difficult to achieve and maintain. Non-alignment between such bearing surfaces may produce unwanted train action forces. The present invention is designed to provide a slackless drawbar arrangement where rotary dumping is not required to overcome the shortcomings and disadvantages of the drawbar arrangement disclosed in the aforesaid U.S. Pat. No. 4,580,686.

SUMMARY OF THE INVENTION

It is an object of the present invention to provide a drawbar support casing to self contain forces developed by a gravity feed wedge for maintaining a slackless relationship of parts connecting an end portion of a drawbar by a vertical pin to the casing by which buff and draft train forces are transmitted to a center sill of a railway vehicle.

It is a further object of the present invention to provide a slackless drawbar arrangement having a quick disconnect function by the construction and relationship of a vertically removable pin used for vertical and horizontal angling of the drawbar in a support casing.

It is still a further object of the present invention to provide an improved slackless drawbar arrangement wherein a gravity feed wedge is supported in a drawbar support casing attached to a center sill to urge a rear support against a drawbar end which in turn urges a bearing block in a vertical pin hole and the drawbar against a vertical pin held by top and bottom pin holes in the drawbar support casing.

It is another object of the present invention to provide an improved slackless drawbar wherein alignment between buff and draft bearing surfaces can be consistently maintained independently of wear of the surfaces during normal operation and thereby avoid train action forces causing wear and tear on the rolling stock and the development of forces that might otherwise cause tracking problems by the truck assembly on the rails.

According to the present invention there is provided a drawbar coupler for a railway car having a center sill, the drawbar coupler including a drawbar having a vertical pin hole extending between top and bottom surfaces forwardly of a truncated, spherically shaped buff load transfer butt end portion, a rear support block having a rear surface and an oppositely facing surface formed with a truncated hemispherical shaped buff load bearing surface engagable with the truncated spherically shaped buff bearing surface of the drawbar, a carrier housing dimensioned to fit in the center sill and attached thereto for transferring buff and draft loads from the drawbar to the center sill, a drawbar bearing block having a rearwardly facing draft load transfer surface engaged with the drawbar in the vertical pin hole, the drawbar bearing block further having a forwardly facing draft load transfer surface, a drawbar pin having an annular pin surface engaged with the forwardly facing draft load transfer surface of the drawbar bearing block, the drawbar pin being operably connected to the carrier housing for transferring draft forces from the drawbar to the center sill and a gravity responsive slack adjusting wedge interposed between the tapered rear surface of the rear support block and the carrier housing.

Preferably the center sill is provided with an opening to allow vertical withdrawal of the drawbar pin and a retainer member traverses the carrier housing at the bottom of the center sill at a sight to prevent dropping of the drawbar pin from the carrier housing. Rearwardly of the drawbar pin, the carrier housing is provided with a cavity wherein the slack adjusting wedge can protrude to a pre-determined extent displayed, for example, by a signal device connected to the wedge and protruding through a suitable opening in the carrier housing and the top wall of the center sill. The signal device indicating, as long as visible, a remaining wear life that will maintain slackless operation of the drawbar. However when the signaling device is no longer visible, there is indicated a degree of wear to the drawbar parts which no longer provides slackless operation; thus calling for replacement of the wedge and/or other parts.

BRIEF DESCRIPTION OF THE DRAWINGS

These features and advantages of the present invention as well as others will be more fully understood when the following description is read in connection with the accompanying drawings which form part of the specification; and in which.

DETAILED DESCRIPTION OF THE DRAWINGS

Figure 1:
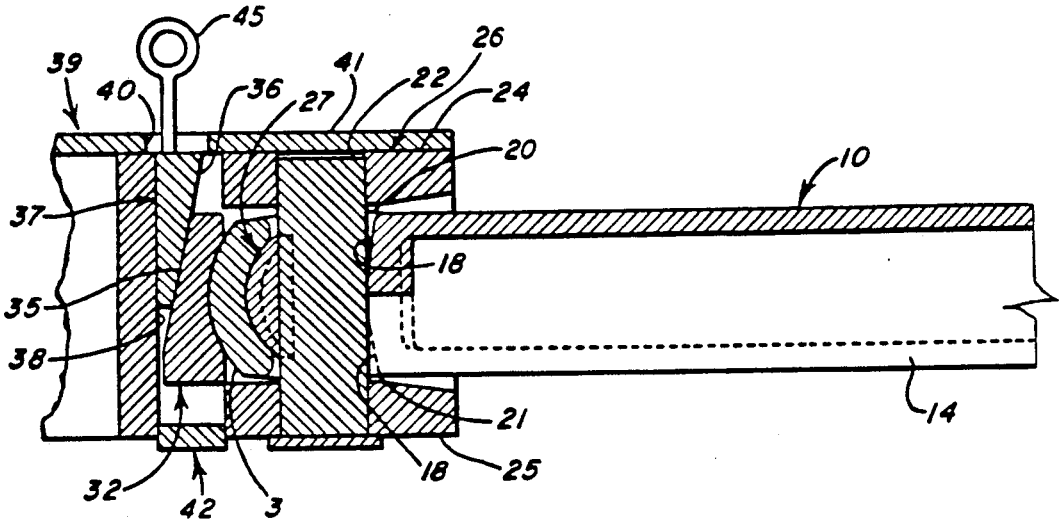
FIG. 1 is an elevational view in section through a slackless drawbar according to the present invention.
Figure 5:
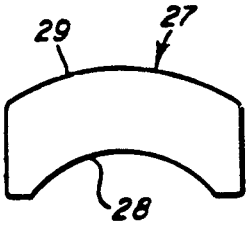
FIG. 5 is a plan view of a bearing block forming part of the drawbar of the present invention.
Figure 6:
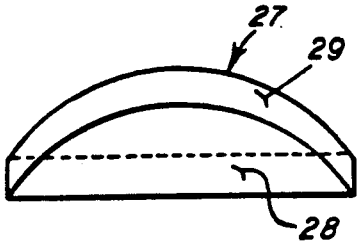
FIG. 6 is a side, elevational view of the bearing block shown in FIG. 5.
Figure 7:
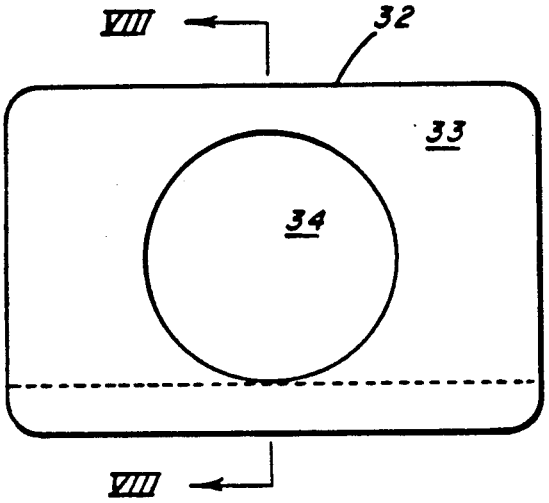
FIG. 7 is a front elevational view of a rear support block forming part of the drawbar of the present invention.
Figure 8:
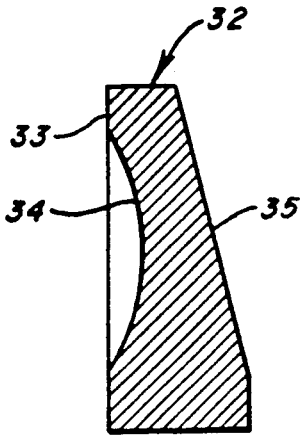
FIG. 8 is a sectional view taken along line VIII—VIII of FIG. 7.
Figure 11:
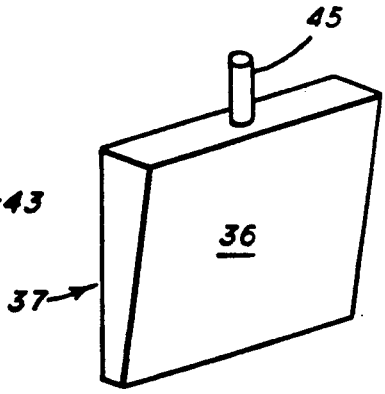
FIG. 11 is a isometric view of a slack adjustment wedge forming part of the drawbar of the present invention.

In FIG. 1 there is illustrated the preferred embodiment of the slackless drawbar according to the present invention. As can be seen there is a drawbar casting 10 having an enlarged end portion 12 shown in plan view in FIG. 2. The drawbar includes a drawbar body 14 which can be of a tubular or solid construction and forms the interconnecting member between railway cars that are to be interconnected. The enlarged end portion 12 includes laterally projecting enlargements between a vertical pin hole 16 formed in-part by a forward pin hole wall portion with diverging wall sections 18 extending toward the top and bottom surfaces 20 and 21, respectively, of the end portion 12. The diverging wall sections 18 allow vertical angling of the drawbar about a drawbar pin 22. The pin 22 is preferably a solid annular member of constant diameter that is received at its opposite end portions in openings 23 provided in the top and bottom walls 24 and 25 of a drawbar support casing or carrier housing 26. The pin 22 is tightly fitted in these openings 23 by an assembly of parts that includes a bearing block 27, illustrated in FIGS. 5 and 6, having an annular face surface 28 engaged with pin 22 and an oppositely directed convex surface 29 extending vertically and engagable with a similarly shaped concave surface 30, in FIGS. 1 and 2, in the rearwardly directed part of the pin hole 16. The terminal end portion of the drawbar casting 10 has a truncated, hemispherical butt end surface 31 by which buff forces are transferred to a rear support block 32, (FIGS. 7 and 8) having a face 33 provided with hemispherical buff load surface 34. Opposite surface 34 there is provided on the support block 32 a tapered face 35 that engages with a similarly tapered surface 36 of a gravity actuated slack-adjusting wedge 37 (FIG. 11). The wedge 37 is supported against a rear wall 38 of the drawbar support casing 26.

Figure 3:
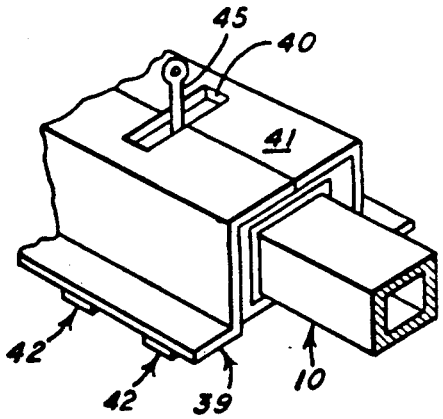
FIG. 3 is an isometric view of a center sill of a railway vehicle embodying the drawbar according to FIG. 1.
Figure 4:
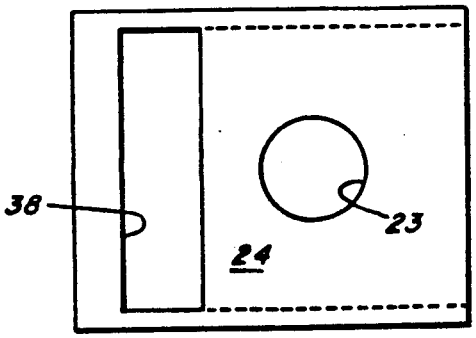
FIG. 4 is a plan view of a support casing forming part of the drawbar of the present invention.
Figure 9:
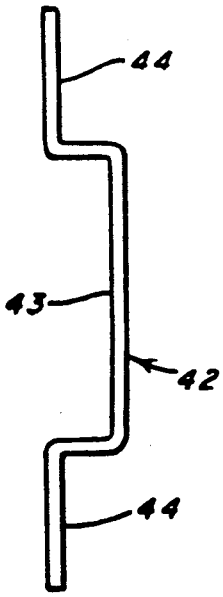
FIG. 9 is a side elevational view of a support plate forming part of the drawbar of the present invention.
Figure 10:
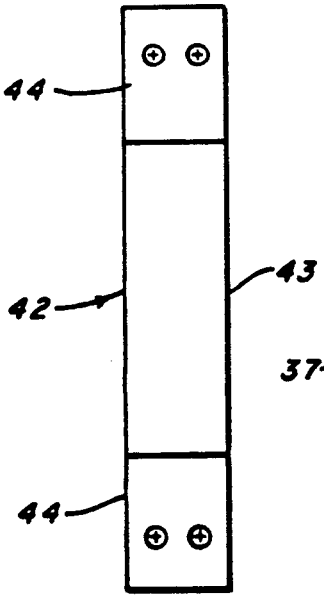
FIG. 10 is a front view of the support plate shown in FIG. 9.

An important feature of the present invention is an arrangement of parts to allow quick disconnect feature of the drawbar casting 10 from a center sill 39 of the car body. The drawbar support casing 26 as shown in FIG. 3 is welded or otherwise attached to the center sill 39 and an opening 40 is provided in the top wall 45. The opening 40 enables a lift lug 45 engaged with the slack adjusting wedge 37 to protrude above the center sill 39 and provide a visual indication of the height of the wedge 37 so that when wear occurs to the extent that the lift lug 45 drops out of sight the need for replacement of the wedge 37 or other worn parts is apparent. A support plate 42 (FIGS. 9 and 10) is fastened by bolts or other members to the drawbar support casing 26 to maintain the support block 32 in the internal cavity of the support casing 26. The support plate 42 has a "U-shaped" configuration formed by center section 43 joined by offset legs 44 having openings for fasteners. As best shown in FIG. 1, 3, 9 & 10, the center section (43) of the support plate (42) extends into the support casing (26) to provide support for the support block (32). When it is desired for example, to disconnect the drawbar 10 from the railway vehicle the slack adjusting wedge 37 is lifted to eliminate metal to metal contact between the support block 32, drawbar casting 10 and pin 22. Such lifting of the slack adjusting wedge (37) can be accomplished, for example, by a hook engaging the lifting lug (45) secured to the wedge (37). Thereafter, a pin 22 support plate 46 which extends across the opening 23 of the bottom wall of the support casing 26 is removed thus allowing access and removal of the drawbar pin 22. Thereafter, the drawbar casting 10 can be simply pulled from the support casing 26 for inspection and repair of any worn parts.

Figure 2:
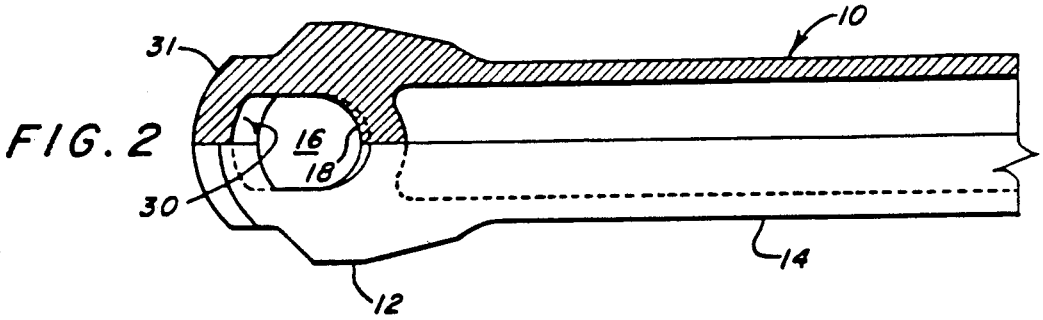
FIG. 2 is an enlarged plan view, partially in section, of a drawbar member shown in FIG. 1.

As can be seen from FIGS. 1 and 2, the buff bearing surfaces on the drawbar casting 10 and the rear support block 32 embody a design specifically intended to reduce the surface contact area and at the same time assure uniform wear because of substantially uniform loading due to buff forces. Also, the drawbar coupler of the present invention eliminates the need for costly machining of all load transfer surfaces. The truncated feature of the hemispherical surfaces is designed preferably such that the length of arc of the surfaces be approximately equal to the radius of curvature.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A drawbar coupler for a railway car having a center sill, said drawbar coupler including: a drawbar casting having a vertical pinhole extending between top and bottom surfaces forwardly of a truncated, spherically shaped buff load transfer surface at a butt end portion thereof, a rear support block having a truncated, substantially hemispherically shaped buff load bearing surface engagable with said truncated spherically shaped buff load transfer surface, and a tapered rear surface, a drawbar support casing attached and dimensioned to fit in such center sill for transferring buff and draft loads from said drawbar casting to such center sill, said support casing having openings for receiving a drawbar pin, said support casing includes a rear wall and mutually perpendicular and generally planar top and bottom walls, said top and bottom walls having openings for receiving opposite end portions of said drawbar pin, said top wall of said support casing having a passageway for installing a gravity responsive slack adjusting wedge between said rear support block and said rear wall of said support casing, a drawbar bearing block having a rearwardly facing draft load transfer surface engaged with said drawbar casting in said vertical pinhole, a drawbar pin received in said vertical pinhole of said drawbar casting and in said drawbar support casing openings having an annular pin surface engaged with said forwardly facing draft load transfer surface of said drawbar bearing block, said drawbar pin being operably connected to said drawbar support casing for transferring draft forces from said drawbar casting to such center sill; and said gravity responsive slack adjusting wedge engaging said tapered rear surface of said rear support block.

2. The drawbar coupler according to claim 1 wherein said rear wall of said drawbar support casing forms a buff load receiving surface engagable with said gravity responsive slack adjusting wedge.

3. The drawbar coupling according to claim 1 wherein said bottom wall of said drawbar support casing includes means for limiting downward passage of said gravity responsive slack adjusting wedge.

4. The drawbar coupler according to claim 1 further including means on said bottom wall of said drawbar support casing for preventing downward displacement of said drawbar pin from said vertical pinhole of said drawbar casting.

5. The drawbar coupler according to claim 4 wherein said means includes a retainer plate and fasteners to allow removal of said retainer plate.

6. The drawbar coupler according to claim 1 further including removable means on said bottom wall of said drawbar support casing for retaining said wedge and said rear support block in said drawbar support casing.

7. The drawbar coupler according to claim 6 wherein said removable means includes a retainer plate and fastener to allow removal of said retainer plate.

8. The drawbar coupler according to claim 1 wherein said truncated substantially hemispherically shaped buff load bearing surface is concave.

9. The drawbar coupler according to claim 1 wherein said rear support block includes a tapered rear surface facing opposite said hemispherically shaped buff load bearing surface engagable with a truncated spherically shaped buff load transfer surface at said but end portion of said drawbar casting.

10. A drawbar coupler according to claim 1 further including a signal means for indicating a remaining wear life of said gravity responsive slack adjusting wedge.

11. A drawbar coupler according to claim 10, wherein said signal means is a lifting lug extending above an opening formed in an upper surface of such railway car center sill as long as said gravity responsive slack adjusting wedge has a useful remaining life.

12. A signal device for indicating a remaining wear life of a gravity responsive slack adjusting wedge in a slackless drawbar coupler arrangement, said signaling device comprising a lifting lug secured to an upper surface of said gravity responsive slack adjusting wedge, said lifting lug extending above an opening formed in an upper surface of a railway vehicle center sill member as long as said gravity responsive slack adjusting wedge has a useful remaining life.

13. A signal device according to claim 12 wherein said lifting lug includes an eyelet formed on an outer end thereof.

* * * * *